United States Patent [19]

Shirakawa

[11] Patent Number: 4,540,116

[45] Date of Patent: Sep. 10, 1985

[54] BOTTOM FLAP STRUCTURE IN PAPER BOX FOR LIQUIDS

[75] Inventor: Kiyoshi Shirakawa, Tokyo, Japan

[73] Assignee: Sanyo-Kokusaku Pulp Co., Ltd., Tokyo, Japan

[21] Appl. No.: 558,371

[22] Filed: Dec. 5, 1983

[30] Foreign Application Priority Data

Jul. 1, 1983 [JP] Japan ..... 58-118261

[51] Int. Cl.[3] ..... B65D 5/08

[52] U.S. Cl. ..... 229/38; 229/37 R

[58] Field of Search ..... 229/17 R, 17 G, 37 R, 229/38, 39 R

[56] References Cited

U.S. PATENT DOCUMENTS 681,323 8/1901 Houghland ..... 229/37 R 2,670,127 2/1954 Gleason et al. ..... 229/37 R 4,113,168 9/1978 Shirakawa ..... 229/37 R

*Primary Examiner*—William Price

*Assistant Examiner*—Gary E. Elkins

*Attorney, Agent, or Firm*—Oblon, Fisher, Spivak, McClelland & Maier

[57] ABSTRACT

A bottom structure of a paper box for storage of liquid which includes four bottom panels connected to four side panels, respectively, each of the side panels being connected to an adjacent side panel along first folding lines, the bottom panels being connected to the side panels along second folding lines. The bottom panels are interconnected by third folding lines wherein the difference between a length of respective adjacent third folding lines of the second and fourth bottom panels is at least 10 mm and the cut-edge of the first bottom panel is parallel to at least one of the second folding lines.

1 Claim, 13 Drawing Figures

FIG. 3 PRIOR ART
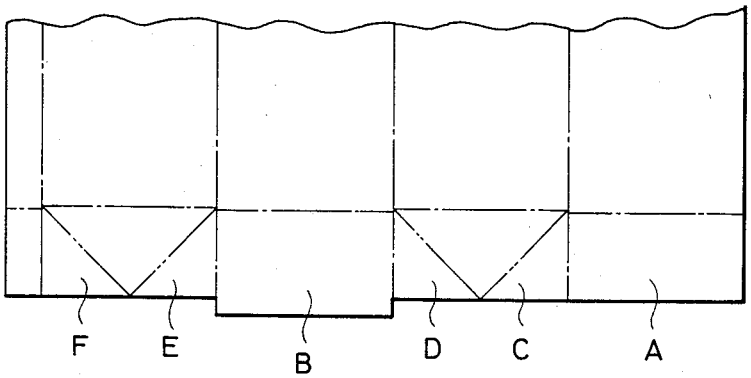
FIG. 4 (A) PRIOR ART
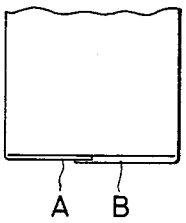
FIG. 4 (B) PRIOR ART
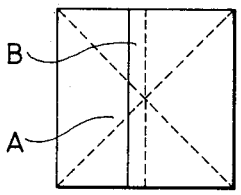
FIG. 4 (C) PRIOR ART
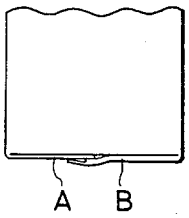
FIG. 4 (D) PRIOR ART
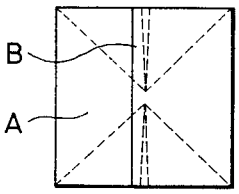

BOTTOM FLAP STRUCTURE IN PAPER BOX FOR LIQUIDS

BACKGROUND OF THE INVENTION

The present invention relates to a bottom structure of a paper box for storage of liquid, and more particularly, relates to a paper box for storage of liquids such as milk, juice, sake, soy sauce and the like.

Recently, various paper boxes made of thermoplastic synthetic resin laminate plate-like paper have been used instead of conventional metal cans or glass bottles as containers for storing liquid such as milk, juice or sake. The reason for this is that the paper boxes have the following advantages;

(a) Since the paper boxes have generally a regular parallelepiped shape, any dead space can be removed and they may be laid one on another in carriage or storage;

(b) The paper boxes are light in weight and thin in thickness in comparison with glass bottles;

(c) The value of goods may be enhanced by applying decorative printing on their outside surface;

(d) The paper boxes may readily be collapsed flat after consuming contents therein;

(e) The paper boxes may be disposed of by burning after use; and (f) The content contained therein may be protected securely.

Conventionally, as such a paper box, there has been a container developed, manufactured for sale by Ex-Cello-O Corporation (Japanese Utility Model Publication No. 4661/71) for milk containers. As shown in FIG. 1, its bottom structure has a plate-like paper structure as indicated by folding lines, i.e., dot-and-dash lines and folding-back lines, i.e., by two-dot-one-dash lines. After a connecting portion G formed along one edge of the plate-like paper is connected with corresponding portion opposite thereto to form a rectangular tube as shown in FIG. 2A, the paper is folded along the folding lines and the folding-back lines as shown in FIGS. 2B to 2D to thereby form the bottom structure. In the container disclosed in the above-mentioned Japanese Utility Model Publication No. 4661/71, one bottom plate A among the two bottom plates A and B forming outermost bottom surface is inserted between the confronting bottom plate B and the folded inside portions as shown in FIGS. 2A to 2D. Since the edges of the folded portions C and D, E and F are intimately contacted with each other by a precise arrangement for folding, the container has the above-described advantages that the liquid contained therein will not leak, however there has been a fear that, when the end of the bottom plate is inserted into an extremely narrow gap between bottom plate B and folded portions D, E as shown in FIG. 2C, the end of the bottom plate A may be folded back midway in the process.

In order to overcome these defects, a paper box having the end portion of the bottom plate A removed as shown in FIG. 3 has been manufactured and available in the market. However, the bottom structure of the paper box is made up of a half-size bottom plate which is overlapped in part only by the other half-size bottom plate when folded, and, in association with the folding-back portions C, D, E and F, each edge thereof does not always abut precisely with the others unlike the preferred paper box illustrated by FIG. 4A, but poor overlapping is likely to be caused as in the case of sub-standard boxes illustrated by FIG. 4C in which case liquid contained therein is threatened to leak through gaps therebetween and the boxes of such structure have eventually led to a deteriorated quality of box.

SUMMARY OF THE INVENTION

The inventor of the present invention has conducted studies and research to solve the problem of removing the present defects; and has completed the present invention in which, unlike the Japanese Utility Model Publication No. 4661/71, there has been provided no end portions on the bottom plate A to be inserted between the corresponding bottom plate B and folded inside portions and has confirmed the same effect as achieved by the Japanese Utility Model Publication No. 4661/71 where the portions on the bottom plate A was inserted therebetween for configurating the bottom of the paper box.

The present invention is characterized in that there is provided a bottom structure of a paper box for storage of liquid, including four side panels each connected to four bottom panels, each side panel being connected to an adjacent panel along folding lines, said bottom panels being connected to said side panels along folding lines, each folding line extending from the folding lines amongst said side panels, said bottom panels making a pair with the opposing bottom panel each to be folded along the folding lines between the side and bottom panels and their end portions to be overlapped with each other for heat-sealing to form an outermost bottom surface, said bottom panels making themselves a pair with an opposing bottom panel, each composing itself in isosceles triangular portion to be folded along the folding line between bottom and side panels to serve as an innermost portion of the bottom, and folding-back portions to be folded back along oblique lines extending from the corner of the latter pair of bottom panels to be heat-sealed with said isosceles triangular portions, said bottom structure formed of paper or synthetic resin plate-like paper heat-sealable on both sides, being characterized in that the edges of the folding-back portions on both sides of said innermost portions are cut off at the apex of the isosceles triangular portion, the cut-off edges forming an oblique line with respect to the folding line between the innermost portion and the side plate, the difference in length of folding line of the folding-back portions located on one side of the innermost bottom portion and adjacent to one of the bottom panels and length of folding line of the folding-back portion located on the other side of the innermost bottom portion and adjacent to the other bottom panels being more than 10 mm, and the cut-off edges of the bottom panels having a folding line for the folding-back portions contiguous thereto and longer than that between the other folding-back portion and the outermost bottom panel, the end of the cut-off edge to be connected to the end of the connecting portion being parallel to the folding line between the bottom panel and the side panel contiguous thereto.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

FIG. 3 is a view of the bottom structure of a conventional liquid containing paper box;

FIGS. 4A to 4D are views showing the bottom structure of the liquid containing paper box in accordance with the example shown in FIG. 3, FIG. 4A is a side view of an acceptable product, FIG. 4B is a bottom view of the same, FIG. 4C is a side view of an unacceptable product and FIG. 4D is a bottom view of the same;

DETAILED DESCRIPTION OF THE PREFERRED EMBODIMENTS

The present invention will now be described by way of the embodiment exemplified in the accompanying drawings of FIGS. 5, 6A and 6B.

Figure 5:
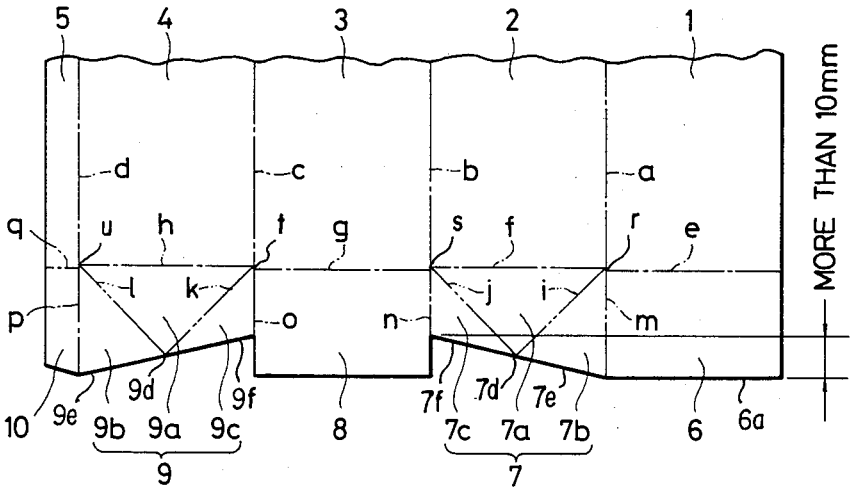
FIG. 5 is a view of one embodiment of the bottom structure of the liquid containing paper box in accordance with the present invention.

In FIG. 5, reference numerals 1, 3 and 2, 4 denote two pairs of opposing side panels, and reference numeral 5 denotes a connecting portion formed integrally with the side panel 4 along folding line d which is to be connected with the back of the side panel 1. The side panels 1 and 2, 2 and 3, and 3 and 4 are integrally connected with each other along folding lines a, b and c respectively. When the side panels 1 and 4 are connected by means of the connecting portion 5, the side wall is formed by the four side panels 1, 2, 3 and 4. Reference numerals 6 and 8 denote bottom panels which are formed integrally with the pair of opposing side panels 1 and 3 respectively along folding lines e and g, and which are overlapped with each other on their end portions for heat-sealing, thereby forming the outermost bottom of the box. Reference numerals 7 and 9 denote bottom panels which are formed integrally with the pair of opposing side panels 2 and 4 respectively along the folding lines f and h and which are folded along the folding lines f and h thereby forming the innermost isosceles triangular portions *7a* and *9a*, the isosceles triangular portions having folding-back portions *7c*, *7b* and *9b*, *9c* respectively along folding-back lines i, j and l, k extending obliquely from corners r, s, t, u of bottom panels 7, 9, these portions to be heat-sealed with the isosceles triangular portions between the isosceles triangular portions and the outermost bottom panels 6 and 8. The cut-off edges *7e*, *7b* and *9e*, *9f* of folding-back portions *7b*, *7c* and *9b*, *9c* are positioned on opposite sides of the innermost isosceles triangular portions *7a* and *9a* and are aligned but oblique with respect to the folding lines f and h, pass through the apexes *7d*, *9d* of the innermost isosceles triangular portions, *7a*, *9a*. Folding-back portions *7b*, *7c* and *9b*, *9c* are defined by the lengths of folding lines m and p of the folding-back portions *7b*, *9b* on one side of the isosceles triangular portions *7a*, *9a* which are adjacent to the outermost bottom panel 6 and by the lengths of the folding lines n and o of the folding-back portions *7c* and *9c* on the other side of the isosceles triangular portions *7a*, *9a* which are adjacent to the outermost bottom panel 8. The difference between the lengths of folding lines m or p and n or o is more than 10 mm, respectively. The cut-off edge *6a* of the outermost bottom panel 6 is parallel to the folding lines e, f, g, h. Incidentally, it is preferable that the isosceles triangular portions *7a* and *9a* have apexes of a right angle or an angle somewhat smaller than right angle in order to ensure a well-balanced formation of a paper box. Such definition of the angle will allow cut-off edges of the folding portions *7b* and *7c*, *9b* and *9c* to abut smoothly. A connecting portion 10 is integrally connected with the connecting portion 5 along folding line q and is to be adhered to the back of the bottom panel 6. The bottom panels 6 and 7, 7 and 8, 8 and 9, and the bottom panel 9 and the connecting portion 10 are connected integrally through the folding lines extending from the folding lines a, b, c and d, each between the side panels 1 and 2, 2 and 3, 3 and 4 and the side panel 4 and the connecting portion 5 respectively.

Figure 1:
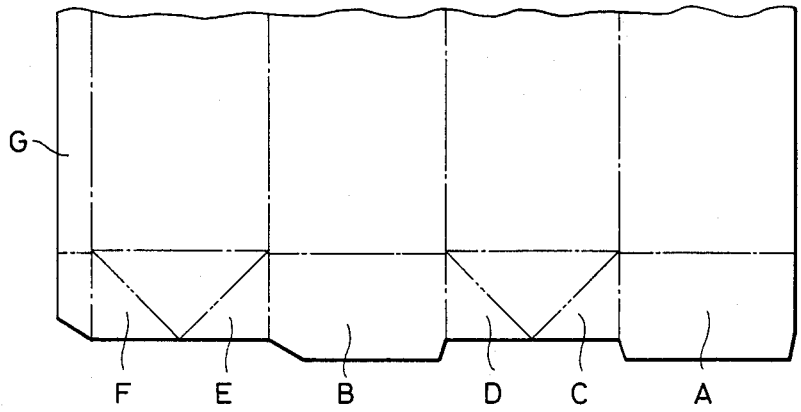
FIG. 1 PRIOR ART
FIG. 1 is a view of one of the examples of the bottom structure of the liquid containing paper box disclosed by the Japanese Utility Model Publication No. 4661/71.
Figure 2A:
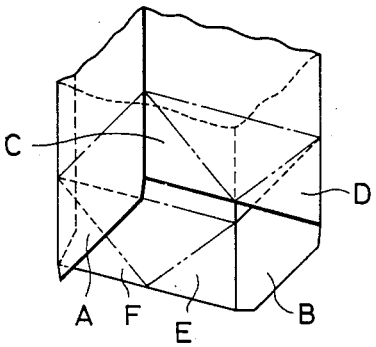
FIG. 2(A) PRIOR ART
FIGS. 2A to 2D are views illustrating a process for forming the bottom structure of the liquid containing paper box in accordance with the example shown in FIG. 1.
Figure 2B:
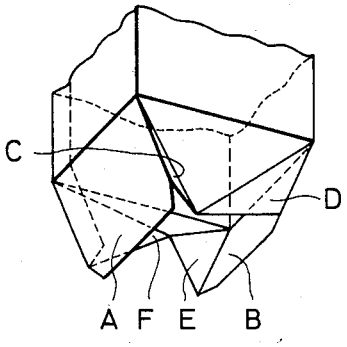
FIG. 2(B) PRIOR ART
Figure 2C:
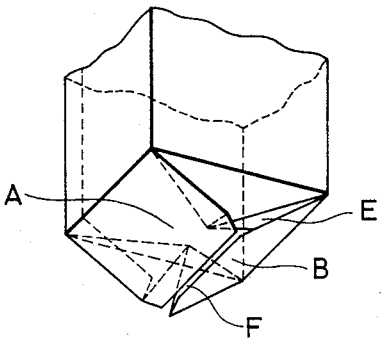
FIG. 2(C) PRIOR ART
Figure 2D:
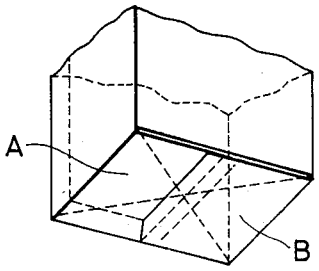
FIG. 2(D) PRIOR ART
Figure 6A:
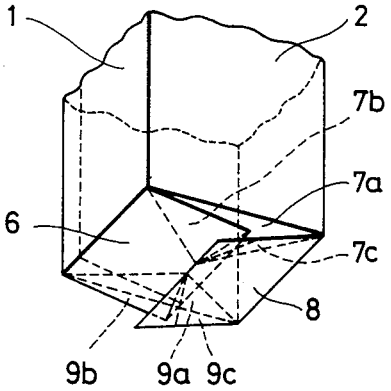
FIG. 6A is a perspective view showing the bottom structure shown in FIG. 5 being formed.
Figure 6B:
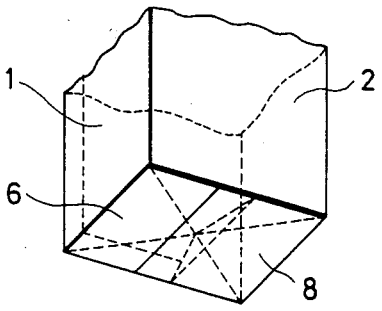
FIG. 6B is a perspective view showing the formed state thereof.

With such bottom structure of the paper box in accordance with the present invention as shown in FIGS. 6A and 6B, the edge of the bottom panel 6 is not only inserted for adhesion between the inner surface of the folding-back portions *7b*, *9b* and the bottom panel 8 but also between the cut-off edge *7f*, *9f* of the inside of folding-back portions *7c*, *9c* and the bottom panel 8. In this case, since the end of the bottom panel 6 is hardly inserted into the gaps defined by the folding-back portions *7c*, *9c* and the bottom panel 8, there is no fear that the edge of the folding-back portion D is overlapped by the edge of the folding-back portion C as in the case of the FIGS. 4C and 4D, and the cut-off edges of the folding-back portions *7b* and *7c*, *9b* and *9c* surely abut, when folded with each other. Also, as in the case of Japanese Utility Model Publication No. 4661/71 exemplified in FIG. 1, there is not specifically provided an insertion piece, i.e., the end of the bottom panel A, to be inserted between bottom panel B opposing to A and the folding-back portion inside the panel B, there is no fear of difficulty in inserting the bottom panels, or possibility for the ends thereof to be creased of folded back. Although the structure of the present invention is different from that of the conventional counterpart, the assembling process of the present paper boxes is substantially the same as that of the conventional counterpart. It is therefore sufficient to modify but slightly the assembling process and forming means of the conventional liquid containing paper box and the paper consumption for the paper box to be manufactured according to the present invention is substantially the same as that for the conventional paper boxes. Moreover, in accordance with the present invention, the design of the paper box is wholly linear and free from the use of irregular shapes of design as in the afore-mentioned Japanese Utility Model Publication No. 4661/71. Thus, the present invention enjoys various advantages and industrial value.

What is claimed is:

1. A bottom structure and a paper box for storage of liquid, comprising:

first, second, third and fourth bottom panels (6, 7, 8, 9) connected to first, second, third and fourth side panels (1, 2, 3, 4), respectively, each of said side panels being connected to an adjacent side panel along respective first folding lines (a, b, c), said bottom panels each being connected to said side panels along second folding lines (e, f, g, h) extending from said first folding lines (a, b, c) between the adjacent side panels (1, 2, 3, 4), said bottom panels (6, 7, 8, 9) being folded along said second folding lines (e, f, g, h) and said first and third bottom panels (6, 8) being adapted to be overlapped at end portions thereof with each other for heat-sealing so as to form an outermost bottom portion; and a connecting portion (5, 10) for interconnecting said first and fourth side panels (1, 4) and for interconnecting said first and fourth bottom panels (6, 9), said second and fourth bottom panels (7, 9) being opposed and each including an isosceles triangular innermost portion (*7a*, *9a*) to be folded along two of said second folding lines (f, g) and first and second folding-back portions (*7b*, *7c*; *9b*, *9c*) to be folded back along oblique folding-back lines (i, j, k, l) extending from opposite corners (r, s, t, u) of said second and fourth bottom panels (7, 9), said bottom structure being formed of the same type of paper on both sides thereof, wherein cut-off edges (*7e*, *7f*; *9e*, *9f*) of the respective folding-portion (*7b*, *7c*; *9b*, *9c*) pass through an apex of said triangular innermost portions (*7a*, *9a*), respectively, said cut-off edges (*7e*, *7f*; *9e*, *9f*) each forming a straight line runningoblique with respect to said second folding lines (e, f, g, h), said bottom panels (6, 7, 8, 9) being interconnected by third folding lines (m, n, o, p) and wherein the difference between a length of respective adjacent third folding lines (m, n; o, p) of said second and fourth bottom panels (7, 9) is at least 10 mm and the cut-off edge (*6a*) of said first bottom panel (6) of said bottom panels (6, 7, 8, 9) is parallel to at least one of said second folding lines (f).

* * * * *